United States Patent [19]

Otteson

[11] Patent Number: 4,831,798

[45] Date of Patent: May 23, 1989

[54] GROUND ANCHORING STAKE

[76] Inventor: Jack O. Otteson, Rt. 3, Box 79, Laurinburg, N.C. 28352

[21] Appl. No.: 138,357

[22] Filed: Dec. 28, 1987

[51] Int. Cl.[4] ..... E02D 5/80

[52] U.S. Cl. ..... 52/153; 52/155; 135/118; 119/121

[58] Field of Search ..... 52/153, 154, 155, 157, 52/158, 169.12; 411/439, 485; 135/118-120, 900; 119/121; D30/44

[56] References Cited

U.S. PATENT DOCUMENTS

| | | | |
|---|---|---|---|
| 1,555,322 | 9/1925 | Kleinhesselink | 135/118 |
| 1,676,197 | 7/1928 | Marrinan | 411/485 X |
| 2,812,743 | 11/1957 | Dustin . | |
| 3,009,550 | 11/1961 | Deamud | 52/153 |
| 3,070,068 | 12/1962 | Chapman . | |
| 3,216,741 | 11/1965 | Newlin et al. | 52/169.12 X |
| 3,280,829 | 10/1966 | Glendenning | 135/118 |
| 3,703,160 | 11/1972 | Biddle . | |
| 3,812,616 | 5/1974 | Kozoil . | |
| 4,038,997 | 8/1977 | Smith . | |
| 4,063,567 | 12/1977 | Martin et al. . | |
| 4,077,418 | 3/1978 | Cohen . | |
| 4,144,843 | 3/1979 | Schrougham . | |
| 4,335,868 | 6/1982 | Ribbert . | |
| 4,432,382 | 2/1984 | Wolf | 135/118 |
| 4,533,112 | 8/1985 | Santos, Jr. et al. . | |

FOREIGN PATENT DOCUMENTS

| | | | |
|---|---|---|---|
| 85518 | 5/1955 | Norway | 411/485 |
| 21637 | 11/1900 | United Kingdom | 411/485 |
| 179110 | 5/1922 | United Kingdom | 411/485 |
| 477961 | 1/1938 | United Kingdom | 411/485 |

*Primary Examiner*—David A. Scherbel
*Assistant Examiner*—Richard E. Chilcot, Jr.
*Attorney, Agent, or Firm*—MacMillan, Sobanski & Todd

[57] ABSTRACT

A ground anchoring stake adapted for use in securing animal traps, tent straps or ropes, and similar devices to the ground is disclosed. The stake includes an elongated cylindrical body having an upper head portion and a lower sharpened end portion. A bail is connected to or formed integrally with the body. A first portion of the bail extends outwardly from the body at a point which is below the upper head portion. The first portion of the bail curves upwardly so as to be oriented generally parallel to the body and extend above the upper head portion. An upper curved portion of the bail is disposed above the head portion of the body. A tail portion of the bail extends downwardly from the upper curved portion parallel to the body. The tail portion extends well below the upper head portion of the body. The upper curved portion of the bail permits a universal pivoting connection to be easily established between the stake and a connecting member attached to the anchored device. The shape of the bail also permits the stake to be used in multiple staking arrangements without defeating the universal pivoting connection.

9 Claims, 1 Drawing Sheet

GROUND ANCHORING STAKE

BACKGROUND OF THE INVENTION

The present invention relates to an improved structure for a ground anchoring stake adapted for use in securing animal traps, tent straps or ropes, and similar devices to the ground.

Stakes have long been used to securely anchor various types of devices at desired locations in undeveloped areas of ground. Such stakes are generally designed so as to resist the withdrawal thereof from the ground, thereby permitting these devices to be reliably retained therein. Typically, one end of a chain, rope, or similar connecting member is attached to the stake. The other end of the connecting member is attached to the device (which may be an animal trap, tent, and the like), so as to provide a reliable anchor for the device in the ground at that particular location.

Many different stake structures are known in the art for accomplishing this anchoring function. However, stakes of the prior art suffer from several deficiencies. First, many prior art stakes do not, of themselves, provide a universal pivoting connection between the stake and the connecting member. Consequently, the connecting member often becomes tangled or wrapped about the stake. Of those prior art stakes which do provide such a universal pivoting connection, additional hardware is required, thus increasing the expense and complexity thereof.

Second, most prior art stakes do not readily permit a second stake to be used in a multiple staking arrangement with the first stake. Multiple staking arrangements involve the use of two or more stakes which engage or are otherwise connected to each other in the ground so as to increase the amount of force required to withdraw them. Multiple staking arrangements are necessary when the device to be anchored might be subject to relatively large forces attempting to withdraw the stake from the ground. This situation frequently occurs in anchoring traps for larger animals which are strong enough to pull a single stake out of the ground. In those prior art stakes which do permit multiple staking arrangements, the universal connection described above is usually defeated during such usage, or else additional hardware is required.

SUMMARY OF THE INVENTION

The present invention relates to an improved structure for a ground anchoring stake adapted for use in securing animals traps, tent straps or ropes, and similar devices to the ground. The stake includes an elongated cylindrical body having an upper head portion and a lower sharpened end portion. A bail is connected to or formed integrally with the body. A first portion of the bail extends outwardly from the body at a point which is below the upper head portion. The first portion of the bail curves upwardly so as to be oriented generally parallel to the body and extend above the upper head portion. An upper curved portion of the bail is disposed above the head portion of the body. A tail portion of the bail extends downwardly from the upper curved portion parallel to the body. The tail portion extends well below the upper head portion of the body. The sharpened end portion of stake may driven into the ground by pushing or striking the head portion. The upper curved portion of the bail permits a universal pivoting connection to be easily established between the stake and a connecting member attached to the anchored device. The shape of the bail also permits the stake to be used in multiple staking arrangements without defeating the universal pivoting connection.

It is an object of the present invention to provide an improved structure for a ground anchoring stake adapted for use in securing animal traps, tent straps or ropes, and the similar devices to the ground.

It is another object of the present invention to provide such an improved stake which easily permits a universal pivoting connection to be established between the stake and a connecting member secured thereto.

It is a further object of the present invention to provide such an improved stake which can be used in multiple staking arrangements without defeating the universal pivoting connection.

Other objects and advantages of the present invention will become apparent to those skilled in the art from the following detailed description of the preferred embodiment, when read in light of the accompanying drawings.

DETAILED DESCRIPTION OF THE PREFERRED EMBODIMENTS

Figure 1:
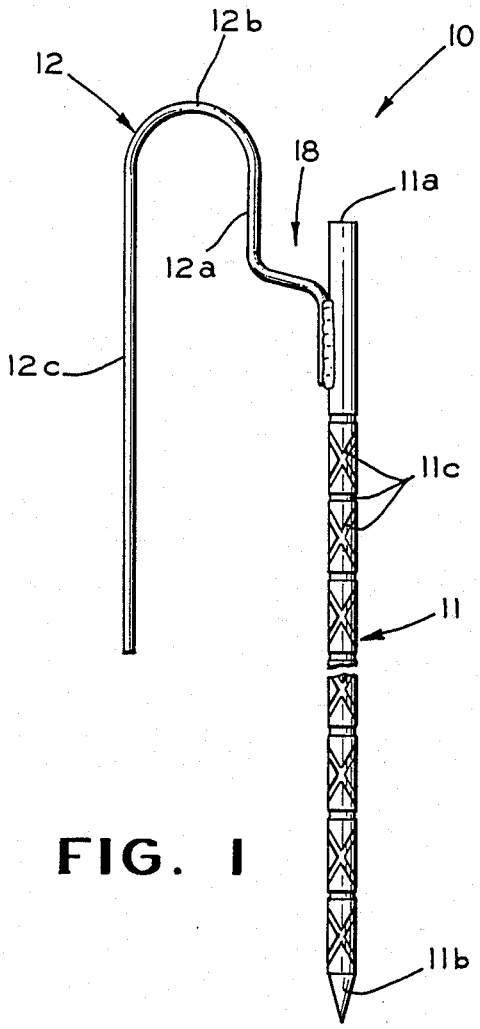
FIG. 1 is a side elevational view of an improved ground anchoring stake in accordance with the present invention.

Referring now to the drawings, there is illustrated in FIG. 1 an improved ground anchoring stake, indicated generally at 10, in accordance with the present invention. The stake 10 includes a body, indicated generally at 11, and a bail, indicated generally at 12. The stake 10 is formed from metal wire stock, although other materials may be used. The body 11 is generally elongated and cylindrical in shape. The body 11 includes an upper flat head portion **11*a* and a lower sharpened end portion 11*b*. The body 11 may be provided with multiple grooves 11*c* on the outer surface thereof, as is commonly known. Although the body 11 may be any convenient size, a length of approximately fifteen inches from the head portion 11*a* to the tip of the sharpened end portion 11*b*** has been found to function satisfactorily.

In the embodiment illustrated in FIG. 1, the bail 12 is formed from a separate piece of material from the body 11. The bail 12 is attached to the body 11 at a point which is located below the upper head portion **11*a*. Such attachment is illustrated as by welding, although other known attachment methods may be used. A first portion 12*a* of the bail 12 extends outwardly from the point of attachment to the body 11. The first portion 12*a* of the bail 12 curves upwardly so as to extend generally parallel to the body 11. The first portion 12*a* continues upwardly above the upper head portion 11*a* of the body 11. An upper curved portion 12*b* is formed integrally with the first portion 12*a*. The upper curved portion 12*b* is generally semi-circular is shape, such that the end thereof which is not formed integrally with the first portion 12*a* extends downwardly generally parallel to the body 11. A tail portion 12*c* is formed integrally with the upper curved portion 12***b* and extends downwardly therefrom. The tail portion 12*c* extends well below the upper head portion 11*a*, preferably approximately half of the length of the body 11, for a reason which will be described below.

The single stake 10 may be used alone for most anchoring applications. A connecting member, such as a conventional chain 15 shown in FIG. 3, can be connected about the upper curved portion 12*b* of the stake 10. The stake 10 (having the chain 15 attached thereto) may then be driven into the ground by pushing or striking the upper head portion 11*a* thereof. As a result, the sharpened end portion 11*b* is driven below the ground level 16 (see FIG. 3) into the ground. The stake 10 may be driven into the ground to the extent illustrated, wherein a small part of the upper curved portion 12*b* thereof is exposed above the ground level 16, or may be further driven such that the the upper curved portion 12*b* is completely below the ground level 16. The upper curved portion 12*b* of the bail 12 permits a universal pivoting connection to be maintained between the stake 10 and the chain 15. Thus, the chain 15 is not likely to become twisted or otherwise bound about the stake 10. Furthermore, since the tail portion 12*c* extends well below the upper head portion 11*a*, the chain 15 is not likely to become accidentally disconnected from the bail 12 by movement of the device anchored thereby.

It can be seen in FIG. 1 that a somewhat U-shaped hook region, indicated generally at 18, is defined between the first portion 12*a* of the bail 12 and the upper end of the body 11 of the stake 10. The utility of this hook region 18 is more readily explained in connection with the multiple staking arrangement illustrated in FIG. 3 and described in detail below. As shown therein, two of the stakes 10 illustrated in FIG. 1 are shown driven below ground level 15. The first stake 10 (having the chain 15 connected thereto) is initially driven into the ground as described above. The second stake 10 is then driven into the ground such that the upper curved portion 12*b* thereof is driven into engagement with the hook region 18 of the first stake 10. This engagement functions to additionally retain the first stake 10 in the ground. Thus, a force sufficient to remove both of the stakes 10 simultaneously is required to be applied on the chain 15 in order to remove the first stake 10 from the ground.

Figure 3:
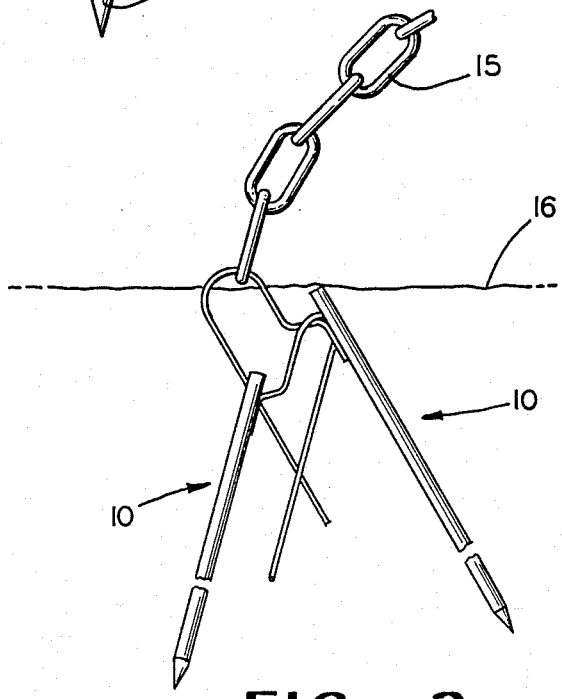
FIG. 3 is a side elevational view of a pair of stakes shown in a multiple staking arrangement.

Since no portion of the second stake 10 is engaged with the upper curved portion 12*b* of the first stake 10, the universal pivoting connection between the first stake 10 and the chain 16 is not defeated by the multiple staking arrangement shown in FIG. 3. It will be appreciated that three or more stakes 10 may be used in such a multiple staking arrangement without defeating this universal pivoting connection.

Figure 2:
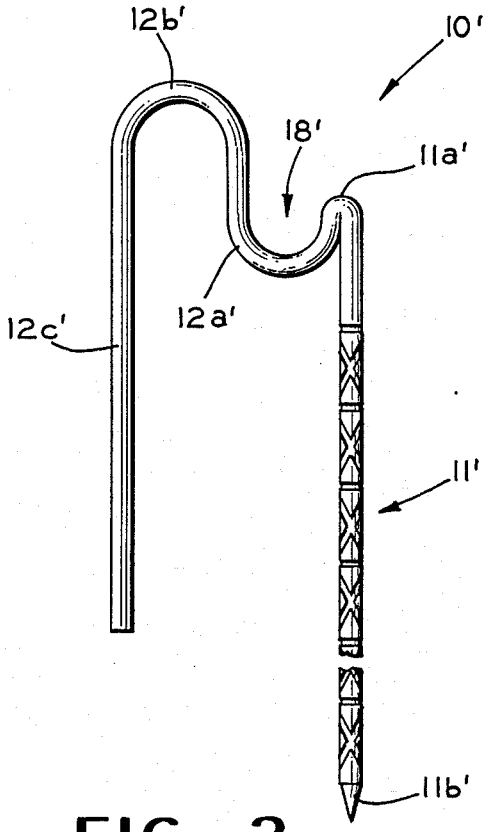
FIG. 2 is a side elevational view of an alternate embodiment of a ground anchoring stake in accordance with the present invention.

FIG. 2 illustrates an alternate embodiment of a ground anchoring stake, indicated generally at 10', in accordance with the present invention. The stake 10' is similar to the stake 10 described above, except that the body 11' and the bail 12' are formed integrally from a single piece of material. Thus, the upper head portion 11*a'* of the body 11' is folded back over such that it extends downwardly therefrom adjacent to the body 11' until it reaches the first portion 12*a'* of the bail 12'. At that point, the first portion 12*a'* of the bail 12' extends outwardly from the body 11', upwardly to the curved upper portion 12*b'*, and downwardly to the tail portion 12*c'*. The stake 10' may be used alone or in the multiple staking arrangement as described above.

In accordance with the provisions of the patent statutes, the principle and mode of operation of the present invention have been explained and illustrated in its preferred embodiments. However, it must be understood that the present invention may be practiced otherwise than as specifically explained and illustrated without departing from its spirit or scope.

What is claimed is:

1. A ground anchoring stake comprising:

an elongated body including an upper head portion and a lower end portion; and a bail including first portion connected to said body below said upper head portion, said first portion extending outwardly from said body and upwardly above said upper head portion so as to define a hook region between said upper head portion of said elongated body and said first portion of said bail, and a second portion extending from said first portion and downwardly below said head portion, whereby said hook region is adapted to receive therein the bail of another ground anchoring stake when used in a multiple staking arrangement.

2. The invention defined in claim 1 wherein said elongated body is formed from wire stock.

3. The invention defined in claim 1 wherein said first portion of said bail is welded to said body portion.

4. The invention defined in claim 3 wherein said second portion of said bail includes an upper curved portion.

5. The invention defined in claim 4 wherein said second portion of said bail further includes a tail portion which extends downwardly from said upper curved portion parallel to said elongated body below said upper head portion.

6. The invention defined in claim 1 wherein said first portion of said bail is formed integrally with said elongated body.

7. The invention defined in claim 6 wherein said first portion includes a folded back portion extending downwardly from said upper head portion of said elongated body before extending outwardly from said body and upwardly above said upper head portion.

8. The invention defined in claim 7 wherein said second portion of said bail includes an upper curved portion.

9. The invention defined in claim 8 wherein said second portion of said bail further includes a tail portion which extends downwardly from said upper curved portion parallel to said elongated body below said upper head portion.

* * * * *